US009689625B2

(12) United States Patent
Dai et al.

(10) Patent No.: US 9,689,625 B2
(45) Date of Patent: Jun. 27, 2017

(54) HEAT PIPE

(71) Applicants: FURUI PRECISE COMPONENT (KUNSHAN) CO., LTD., Kunshan (CN); Foxconn Technology Co., Ltd., New Taipei (TW)

(72) Inventors: Sheng-Liang Dai, Kunshan (CN); Jia-Hong Wu, New Taipei (TW)

(73) Assignees: FURUI PRECISE COMPONENT (KUNSHAN) CO., LTD., Kunshan (CN); Foxconn Technology Co., Ltd., New Taipei (TW)

( * ) Notice: Subject to any disclaimer, the term of this patent is extended or adjusted under 35 U.S.C. 154(b) by 518 days.

(21) Appl. No.: 14/103,855

(22) Filed: Dec. 12, 2013

(65) Prior Publication Data

US 2014/0166246 A1 Jun. 19, 2014

(30) Foreign Application Priority Data

Dec. 14, 2012 (CN) ..... 2012 1 05420202

(51) Int. Cl.
*F28D 15/04* (2006.01)
*F28D 15/02* (2006.01)

(52) U.S. Cl.
CPC ..... *F28D 15/046* (2013.01); *F28D 15/0283* (2013.01); *Y10T 29/49353* (2015.01)

(58) Field of Classification Search
CPC .... F28D 15/046; F28D 15/0283; F28D 15/04; Y10T 29/49353; Y10T 29/49393; B21D 53/06; B23P 2700/09; B23P 2700/10
See application file for complete search history.

(56) References Cited

U.S. PATENT DOCUMENTS 6,656,398 B2 * 12/2003 Birch ..... B29C 33/64 106/38.22
7,517,408 B2 * 4/2009 Hou ..... B22F 3/004 118/306
2008/0142196 A1 * 6/2008 Jeng ..... F28D 15/0233 165/104.26

FOREIGN PATENT DOCUMENTS

CN 101819002 A 9/2010
CN 102359746 A 2/2012
CN 202452870 U * 9/2012
TW 201038896 A1 11/2010
TW 201109608 A 3/2011
TW M426755 A 4/2012

OTHER PUBLICATIONS

Zhou CN202452870U English Translation.*

* cited by examiner

*Primary Examiner* — Jason L Vaughan
*Assistant Examiner* — Amanda Meneghini
(74) *Attorney, Agent, or Firm* — Steven Reiss

(57) ABSTRACT

A method for manufacturing a heat pipe includes following steps: providing a tube; providing a rod; inserting the rod in the circular tube, a receiving portion is formed between an inner face of the tube and the upper portion of the rod; providing an amount of metal powder and filling the metal powder into the receiving portion; sintering the metal powder at a high temperature to form a first wick structure adhered on the inner face of the tube and then drawing the rod out of the tube; injecting a working medium into the tube and sealing the tube to form the heat pipe.

10 Claims, 8 Drawing Sheets

HEAT PIPE

BACKGROUND

1. Technical Field

The disclosure generally relates to heat transfer apparatuses, and particularly to a flat heat pipe with high heat transfer performance and a method for manufacturing the flat heat pipe.

2. Description of Related Art

Heat pipes are widely used in various fields for heat dissipation purposes due to their excellent heat transfer performance. One commonly used heat pipe includes a sealed tube made of heat conductive material, and a working fluid contained in the sealed tube. The working fluid conveys heat from one end of the tube, typically referred to as an evaporator section, to the other end of the tube, typically referred to as a condenser section. Preferably, a wick structure is provided inside the heat pipe, lining an inner wall of the tube, and drawing the working fluid back to the evaporator section after it condenses at the condenser section.

During operation, the evaporator section of the heat pipe maintains thermal contact with a heat-generating electronic component. The working fluid at the evaporator section absorbs heat generated by the electronic component, and thereby turns to vapor. Due to the difference in vapor pressure between the two sections of the heat pipe, the generated vapor moves, carrying the heat with it, toward the condenser section. At the condenser section, the vapor condenses after transferring the heat to, for example, fins thermally contacting the condenser section. The fins then release the heat into the ambient environment. Due to the difference in capillary pressure which develops in the wick structure between the two sections, the condensate is then drawn back by the wick structure to the evaporator section where it is again available for evaporation.

Typically, the wick structure is attached to the whole inner wall of the tube from the evaporator section to the condenser section. As a result, a space in the heat pipe for the vaporized working fluid to flow through may be inadequate. This leads to a high flow resistance for the working fluid, and thereby retards the heat transfer capability of the heat pipe.

What is needed, therefore, is a flat heat pipe that has high heat transfer performance, and a method for manufacturing the flat heat pipe.

DETAILED DESCRIPTION

Figure 1:
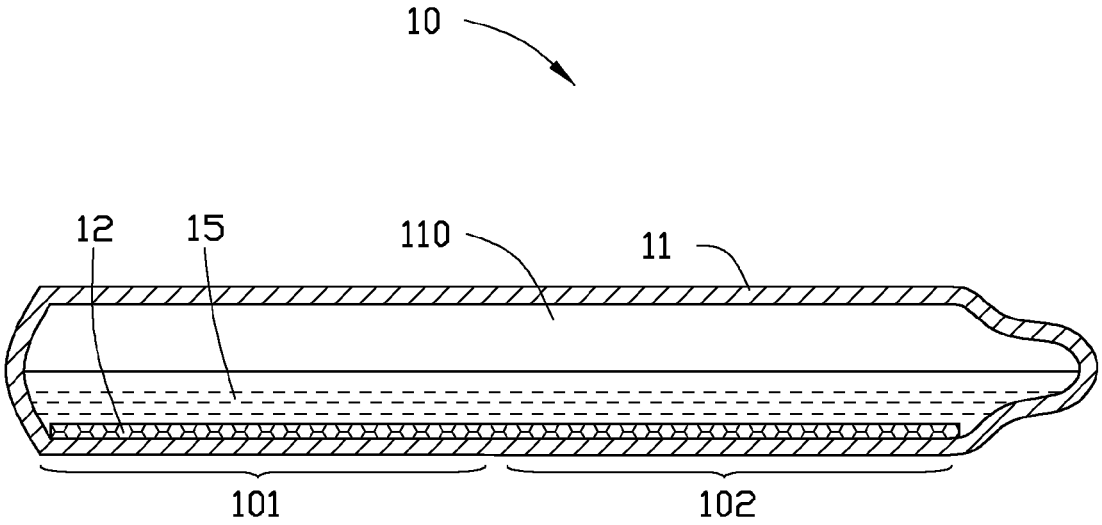
FIG. 1 is a longitudinal cross sectional view of a flat heat pipe in accordance with a first embodiment of the disclosure.
Figure 2:
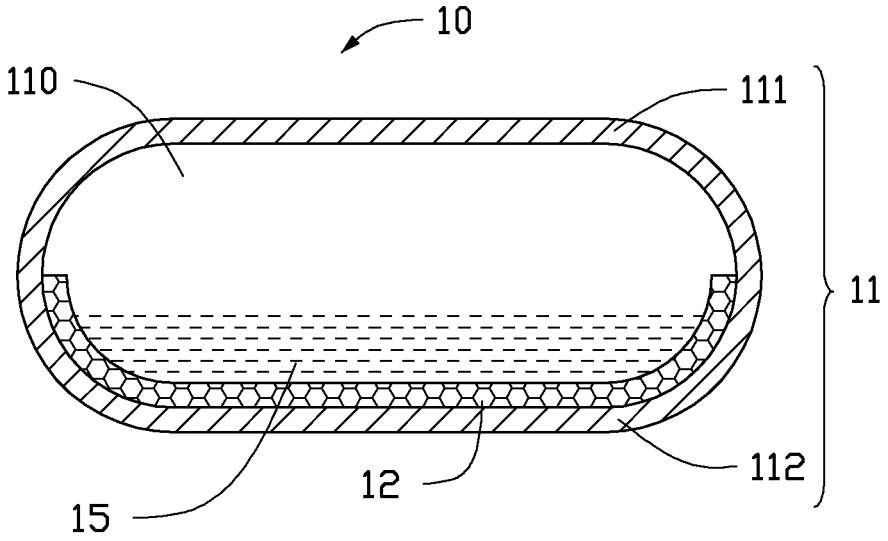
FIG. 2 is a transverse cross sectional view of the flat heat pipe of FIG. 1.

Referring to FIGS. 1-2, a flat heat pipe 10 in accordance with a first embodiment of the disclosure is shown. The heat pipe 10 includes an elongated flat tube 11, a first wick structure 12 adhered on an inner face of the tube 11 along a longitudinal direction of the tube 11, and a working medium 15 injected in the tube 11. The heat pipe 10 has an evaporator section 101 and an opposite condenser section 102 respectively located at two opposite ends of the tube 11.

The tube 11 is made of metal or metal alloy with a high heat conductivity coefficient, such as copper, copper-alloy, or other suitable material. The tube 11 has a width much larger than its height. In particular, the tube 11 has a flattened transverse cross section. The tube 11 is hollow, and longitudinally defines an inner space 110 therein. The tube 11 includes an inverted U-shaped top plate 111, and a U-shaped bottom plate 112 opposite to the top plate 111.

The first wick structure 12 is adhered on the inner face of the bottom plate 112 of the tube 11, and extends from the evaporator section 101 to the condenser section 102. The first wick structure 12 is made of sintered metal powder such as copper powder. The first wick structure 12 provides a large capillary force to drive the condensed working medium 15 at the condenser section 102 to flow toward the evaporator section 101 of the heat pipe 10. In particular, a maximum heat transfer rate ($Q_{max}$) of the first wick structure 12 does not significantly drop after the heat pipe 10 is flattened.

The working medium 15 is injected into the tube 11 and saturates the first wick structure 12. The working medium 15 usually selected is a liquid such as water, methanol, or alcohol, which has a relatively low boiling point. The tube 11 of the heat pipe 10 is evacuated and hermetically sealed after injection of the working medium 15. The working medium 15 can evaporate when it absorbs heat at the evaporator section 101 of the heat pipe 10.

Figure 3:
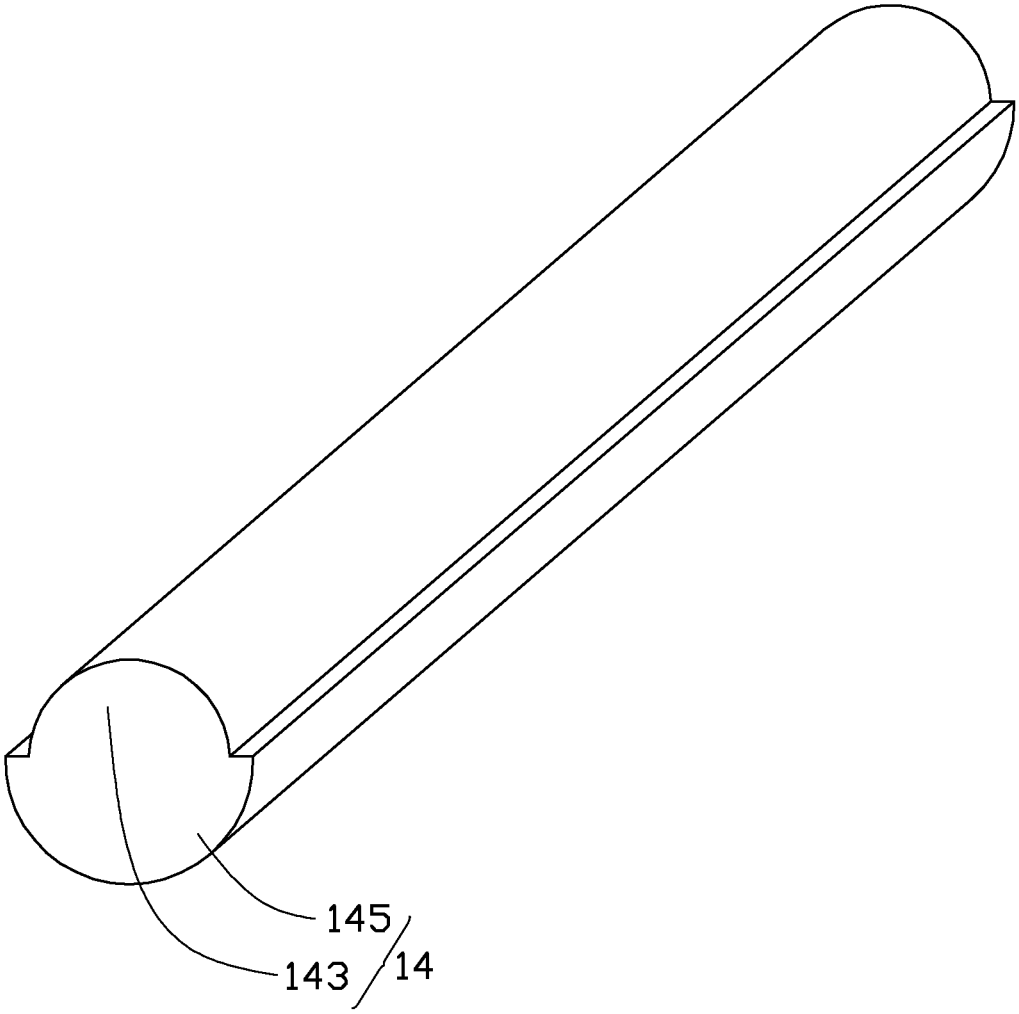
FIG. 3 is an isometric view of a cylindrical rod used for manufacturing the flat heat pipe of FIG. 1.
Figure 4:
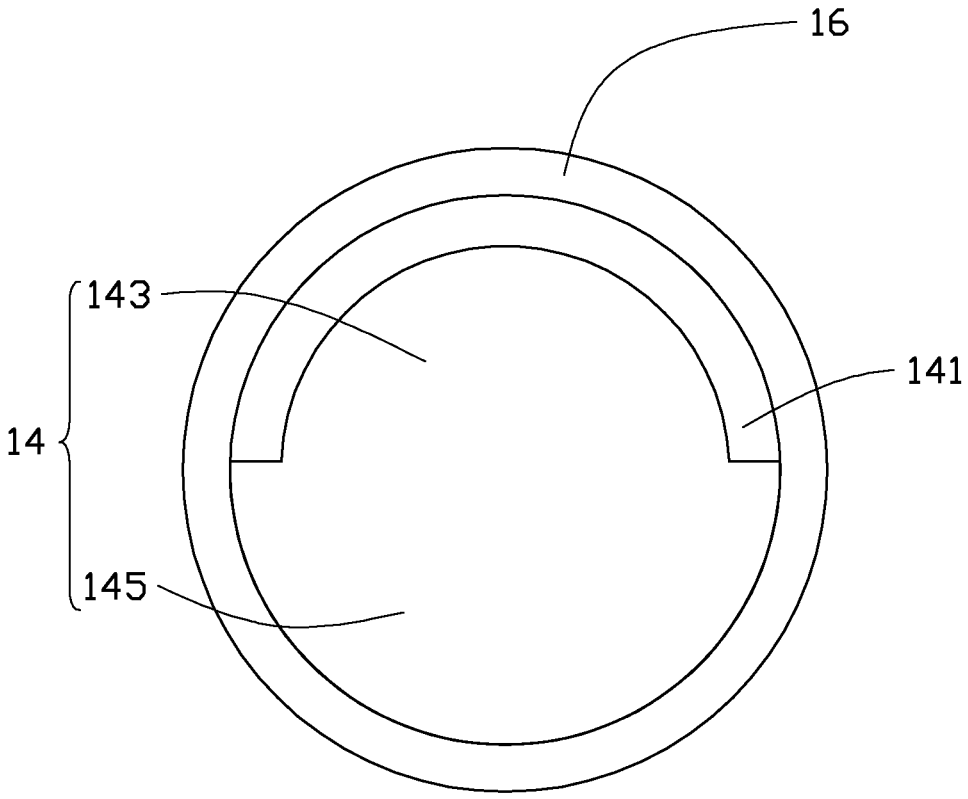
FIG. 4 is a transverse cross sectional view of inserting the cylindrical rod of FIG. 3 into a circular tube.
Figure 5:
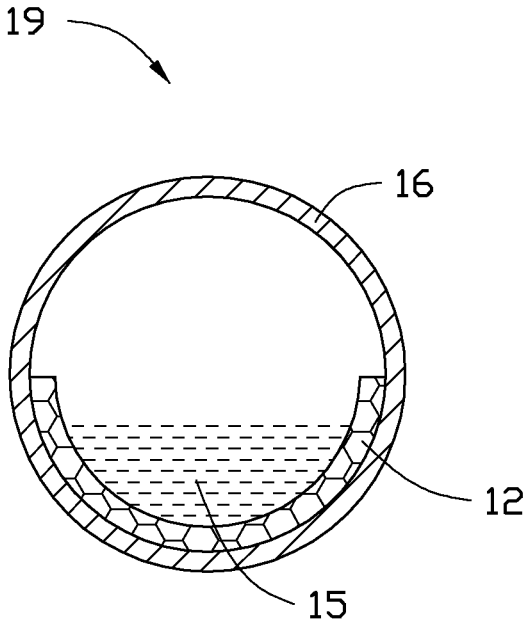
FIG. 5 is a transverse cross sectional view of a circular heat pipe used for manufacturing the flat heat pipe of FIG. 1.

FIGS. 3-5 summarize an exemplary method for manufacturing the heat pipe 10 of the first embodiment. The method includes the following steps:

Firstly, an elongated circular tube 16 is provided.

Secondly, an elongated rod 14 is provided. The rod 14 is made of heat-resistive material. A nitrogen compound thin film is formed on an outer surface of the rod 14 by performing high temperature surface treatment on the outer surface of the rod 14 in nitrogen atmosphere, then an organic mold-release agent is sprayed over the outer surface of the rod 14. Referring to FIG. 3, the rod 14 includes an upper portion 143 and a lower portion 145 opposite to the upper portion 143. A transverse cross section of each of the upper portion 143 and the lower portion 145 is semicircular. The upper portion 143 has a radius less than that of the lower portion 145. The radius of the lower portion 145 is equal to an inner radius of the circular tube 16.

Thirdly, referring to FIG. 4, the rod 14 is inserted in the circular tube 16. Since the radius of the lower portion 145 of the rod 14 is equal to the inner radius of the circular tube 16, an outer face of the lower portion 145 of the rod 14 fits an inner face of the circular tube 16 well. Since the radius of the upper portion 143 is less than the inner radius of the circular tube 16, a receiving portion 141 is formed between the inner face of the circular tube 16 and the upper portion 143 of the rod 14. A transverse cross section of the receiving portion 141 is semicircular ring shaped.

Fourthly, an amount of metal powder is provided and filled into the receiving portion 141 of the circular tube 16. The circular tube 16 is vibrated until the metal powder is evenly distributed along the length of the circular tube 16 in accordance with its particle size.

Fifthly, the circular tube 16 with the rod 14 and the metal powder is sintered at a high temperature to form the first wick structure 12 adhered on the inner face of the circular tube 16, and then the rod 14 is drawn out of the circular tube 16. A transverse cross section of the first wick structure 12 is semicircular ring shaped before the circular tube 16 is flattened.

Sixthly, referring to FIG. 5, the working medium 15 is injected into the circular tube 16, and then the circular tube 16 is evacuated and sealed to form a circular heat pipe 19.

Finally, the circular heat pipe 19 is flattened under an outer force applied onto the circular tube 16 to thereby form the flat heat pipe 10. To ensure the position of the first wick structure 12 is not offset with respect to the circular tube 16 after the circular heat pipe 19 is flattened, the position of the first wick structure 12 needs to be labeled at an exterior of the circular tube 16 before the circular tube 16 is sealed. Various labeling manners can be selected, such as imprinting, drawing with a color pencil, or printing date on the exterior of the circular tube 16 corresponding to the position of the first wick structure 12 in an interior of the circular tube 16. The circular heat pipe 19 is flattened under the outer force applied on the label on the exterior of the circular tube 16 to thereby form the flat heat pipe 10. A transverse cross section of the first wick structure 12 is U-shaped after the circular tube 16 is flattened.

Figure 6:
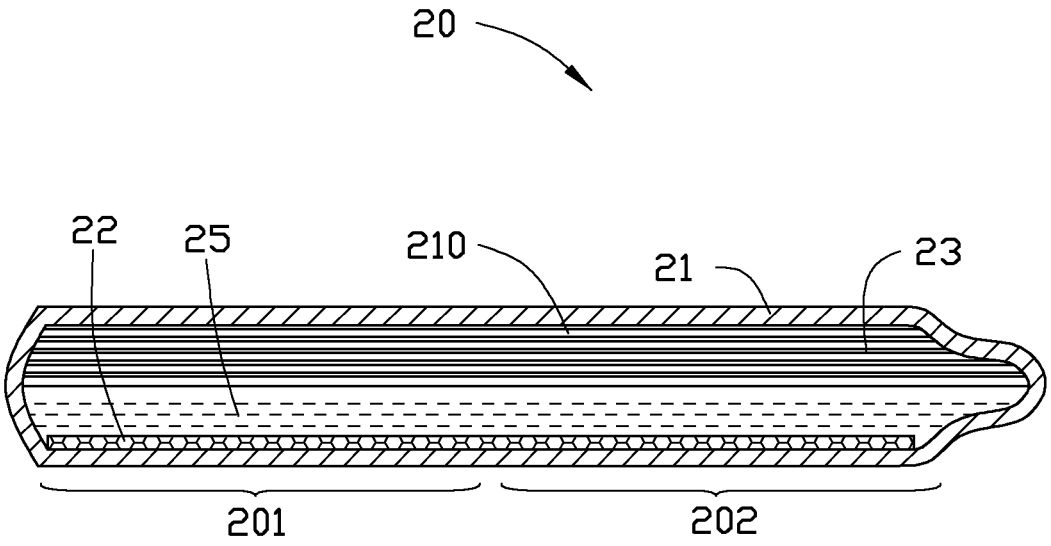
FIG. 6 is a longitudinal cross sectional view of a flat heat pipe in accordance with a second embodiment of the disclosure.
Figure 7:
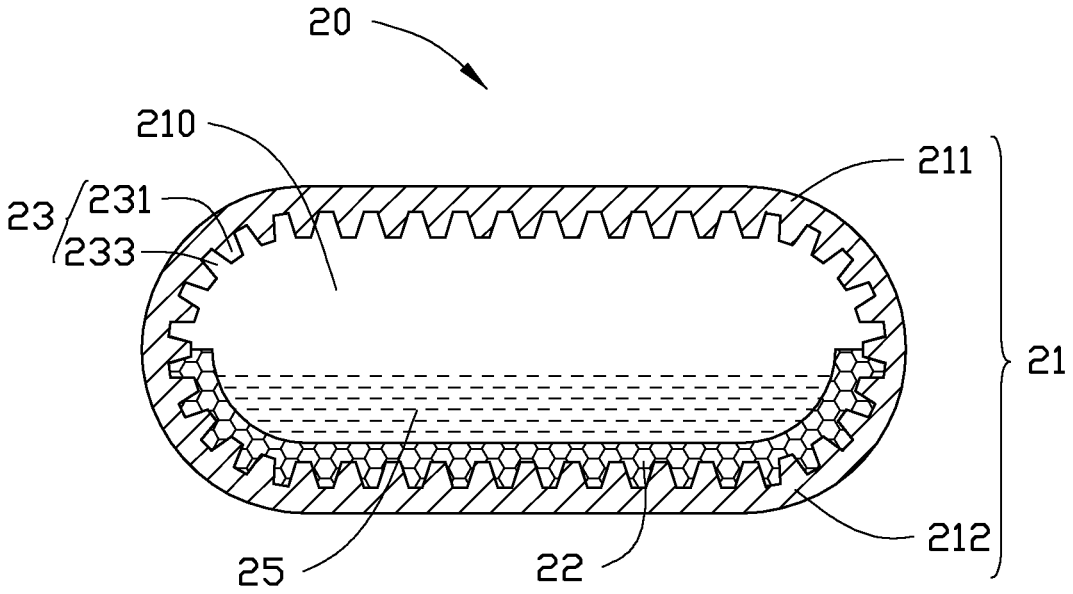
FIG. 7 is a transverse cross sectional view of the flat heat pipe of FIG. 6.

Referring to FIGS. 6-7, a flat heat pipe 20 in accordance with a second embodiment of the disclosure is shown. Similar to the structure of the heat pipe 10 in the first embodiment, the heat pipe 20 includes an elongated flat tube 21, a first wick structure 22 adhered on an inner face of the tube 21 along a longitudinal direction of the tube 21, and a working medium 25 injected in the tube 21. The heat pipe 20 has an evaporator section 201 and an opposite condenser section 202 respectively located at two opposite ends of the tube 21. The tube 21 has a flattened transverse cross section. The tube 21 is hollow, and longitudinally defines an inner space 210 therein. The tube 21 includes an inverted U-shaped top plate 211, and a U-shaped bottom plate 212 opposite to the top plate 211. The top plate 211 has a first flat portion and two first curved portions at two ends of the first flat portion, respectively. The bottom plate 212 has a second flat portion and two second curved portions at two ends of the second flat portion, respectively. The first flat portion is opposite to the second flat portion.

The flat heat pipe 20 differs from the flat heat pipe 10 of the first embodiment in that the heat pipe 20 further includes a second wick structure 23 formed on the entire inner circumferential face of the tube 21. The second wick structure 23 extends longitudinally through the evaporator section 201 and the condenser section 202. The second wick structure 23 provides a large permeability for the working medium 25 and has a low flow resistance to the working medium 25, thereby promoting the flow of the working medium 25 in the flat heat pipe 20. The second wick structure 23 includes a plurality of elongated, spaced protruding portions 231, and a plurality of grooves 233. Each groove 233 is formed between every two adjacent protruding portions 231. A transverse cross section of each protruding portion 231 is trapezoidal. Distal ends of the protruding portions 231 extending from the first flat portion of the top plate 211 are coplanar. Distal ends of the protruding portions 231 extending from the second flat portion of the bottom plate 212 are coplanar. The protruding portions 231 with the grooves 233 therebetween can be formed by etching the inner circumferential face of the tube 21. The first wick structure 22 is attached to a part of the second wick structure 23 which is formed on the inner face of the bottom plate 212 of the tube 21.

In operation, the evaporator section 201 of the flat heat pipe 20 is placed in thermal contact with a heat source (not shown) that needs to be cooled. The working medium 25 contained in the evaporator section 201 of the flat heat pipe 20 vaporizes when it reaches a certain temperature after absorbing heat generated by the heat source. The generated vapor moves from the evaporator section 201 to the condenser section 202. After the vapor releases its heat and condenses in the condenser section 202, the condensed working medium 25 is returned via the first and second wick structures 22, 23 to the evaporator section 201 of the flat heat pipe 20, where the working medium 25 is again available to absorb heat.

Figure 8:
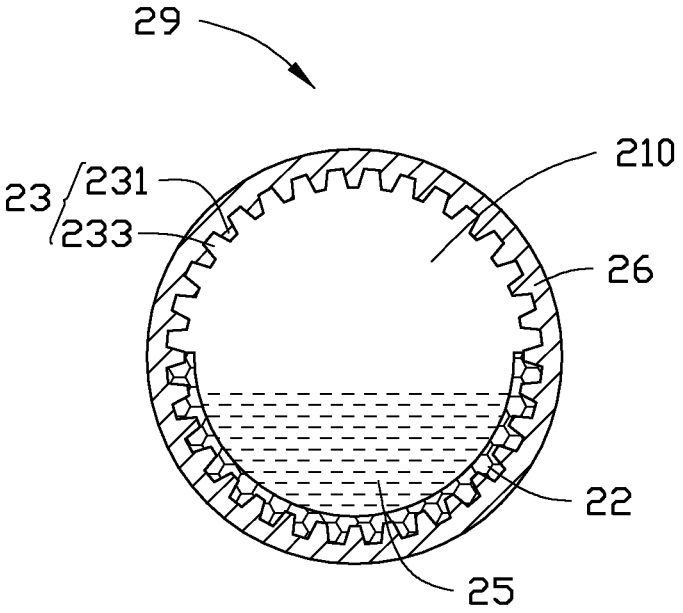
FIG. 8 is a transverse cross sectional view of a circular heat pipe used for manufacturing the flat heat pipe of FIG. 6.

Also referring to FIG. 8, an exemplary method for manufacturing the flat heat pipe 20 of the second embodiment, which is similar to the method for manufacturing the flat heat pipe 10 of the first embodiment, includes the following steps:

Firstly, an elongated circular tube 26 is provided.

Secondly, the elongated rod 14 is provided. The rod 14 is made of heat-resistive material. A nitrogen compound thin film is formed on an outer surface of the rod 14 by performing high temperature surface treatment on the outer surface of the rod 14 in nitrogen atmosphere, then an organic mold-release agent is sprayed over the outer surface of the rod 14. Referring to FIG. 3, the rod 14 includes the upper portion 143 and the lower portion 145 opposite to the upper portion 143. A transverse cross section of each of the upper portion 143 and the lower portion 145 is semicircular. The upper portion 143 has the radius less than that of the lower portion 145.

Thirdly, the rod 14 is inserted in the circular tube 26. Since the radius of the upper portion 143 is less than the inner radius of the circular tube 26, a receiving portion (not shown) is formed between the inner face of the circular tube 26 and the upper portion 143 of the rod 14. A transverse cross section of the receiving portion is substantially semicircular ring shaped.

Fourthly, an amount of metal powder is provided and filled into the receiving portion of the circular tube 26. The circular tube 26 is vibrated until the metal powder is evenly distributed along the length of the circular tube 26 in accordance with its particle size.

Fifthly, the circular tube 26 with the rod 14 and the metal powder is sintered at a high temperature to form the first wick structure 22 adhered on the inner face of the circular tube 26, and then the rod 14 is drawn out of the circular tube 26. A transverse cross section of the first wick structure 22 is substantially semicircular ring shaped before the circular tube 26 is flattened.

Sixthly, the working medium 25 is injected into the circular tube 26, and then the circular tube 26 is evacuated and sealed to form a circular heat pipe 29.

Finally, the circular heat pipe 29 is flattened under an outer force applied onto the circular tube 26 to thereby form the flat heat pipe 20. To ensure the position of the first wick structure 22 is not offset with respect to the circular tube 26 after the circular heat pipe 29 is flattened, the position of the first wick structure 22 needs to be labeled at an exterior of the circular tube 26 before the circular tube 26 is sealed. Various labeling manners can be selected, such as imprinting, drawing with a color pencil, or printing date on the exterior of the circular tube 26 corresponding to the position of the first wick structure 22 in an interior of the circular tube 26. The circular heat pipe 29 is flattened under the outer force applied on the label on the exterior of the circular tube 26 to thereby form the flat heat pipe 20. A transverse cross section of the first wick structure 22 is substantially U-shaped after the circular tube 26 is flattened.

The method for manufacturing the flat heat pipe 20 differs from the method for manufacturing the flat heat pipe 10 of the first embodiment in that: the entire inner circumferential face of the circular tube 26 is etched to form the plurality of elongated, spaced protruding portions 231 with the grooves 233 therebetween before the rod 14 is inserted in the circular tube 26. The protruding portions 231 and the grooves 233 cooperatively form the second wick structure 23. A circle enclosed by the distal ends of the protruding portions 231 has a radius equal to the radius of the lower portion 145 of the rod 14. The first wick structure 22 is attached to the part of the second wick structure 23 which is formed on the inner face of the bottom plate 212 of the tube 21.

It is to be further understood that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method for manufacturing a heat pipe comprising following steps:

providing an elongated circular tube;

providing an elongated rod, the rod comprising an upper portion and a lower portion, a cross section of each of the upper portion and the lower portion being semicircular, the upper portion having a radius less than that of the lower portion, the radius of the lower portion being equal to an inner radius of the circular tube;

inserting the rod in the circular tube, a receiving portion being formed between an inner face of the tube and the upper portion of the rod;

providing an amount of metal powder and filling the metal powder into the receiving portion;

sintering the metal powder at a temperature to form a first wick structure adhered on the inner face of the tube and then drawing the rod out of the tube;

injecting a working medium into the tube, labeling the position of the first wick structure at an exterior of the circular tube and sealing the tube to thereby form the heat pipe; and flattening the heat pipe under an outer force applied on the label on the exterior of the circular tube to thereby form a flat heat pipe.

2. The method for manufacturing the heat pipe of claim 1, wherein before the rod is inserted in the circular tube, a nitrogen compound thin film is formed on an outer surface of the rod by performing high temperature surface treatment on the outer surface of the rod in nitrogen atmosphere, and an organic mold-release agent is sprayed over the outer surface of the rod.

3. The method for manufacturing the heat pipe of claim 1, wherein a transverse cross section of the receiving portion is semicircular ring shaped.

4. The method for manufacturing the heat pipe of claim 1, wherein after the amount of metal powder is filled into the receiving portion of the circular tube, the circular tube is vibrated until the metal powder is evenly distributed along the length of the circular tube in accordance with its particle size.

5. The method for manufacturing the heat pipe of claim 1, wherein a transverse cross section of the first wick structure is semicircular ring shaped.

6. The method for manufacturing the heat pipe of claim 1, wherein a transverse cross section of the first wick structure is U-shaped after the circular tube is flattened.

7. The method for manufacturing the heat pipe of claim 1, wherein the position of the first wick structure is labeled by imprinting, drawing with a color pencil, or printing date on the exterior of the circular tube corresponding to the position of the first wick structure in an interior of the circular tube.

8. The method for manufacturing the heat pipe of claim 1, wherein the entire inner circumferential face of the circular tube is etched to form a plurality of elongated, spaced protruding portions with the grooves therebetween before the rod is inserted in the circular tube, and the protruding portions and the grooves cooperatively form a second wick structure.

9. The method for manufacturing the heat pipe of claim 8, wherein a circle enclosed by distal ends of the protruding portions has a radius equal to the radius of the lower portion of the rod.

10. The method for manufacturing the heat pipe of claim 8, wherein the first wick structure is attached to a part of the second wick structure which is formed on a bottom of the tube.

* * * * *